US007112101B2

(12) United States Patent
Pedret et al.

(10) Patent No.: US 7,112,101 B2
(45) Date of Patent: Sep. 26, 2006

(54) SOCKET USED TO HOUSE FEMALE PLUGS AND MICRO-RELAYS

(75) Inventors: Montserrat Piñol Pedret, Tarragon Valls (ES); Jose Maria Pares Caselles, Tarragon Valls (ES)

(73) Assignee: Lear Corporation, Southfield, MI (US)

( * ) Notice: Subject to any disclaimer, the term of this patent is extended or adjusted under 35 U.S.C. 154(b) by 217 days.

(21) Appl. No.: 10/707,929

(22) Filed: Jan. 26, 2004

(65) Prior Publication Data

US 2004/0174238 A1 Sep. 9, 2004

(30) Foreign Application Priority Data

Aug. 21, 2002 (WO) ..... PCT/ES02/00408

(51) Int. Cl.
*H01R 13/10* (2006.01)

(52) U.S. Cl. ..... 439/682; 335/202

(58) Field of Classification Search ..... 439/682, 439/949, 76.2, 733.1; 335/202, 78
See application file for complete search history.

(56) References Cited

U.S. PATENT DOCUMENTS 5,611,716 A 3/1997 Egenolf ..... 439/857
6,191,672 B1 * 2/2001 Lages et al. ..... 335/202

* cited by examiner

*Primary Examiner*—Tho D. Ta
*Assistant Examiner*—Vanessa Girardi
(74) *Attorney, Agent, or Firm*—Bruce E. Harang

(57) ABSTRACT

A plugboard for housing sockets and micro-relays, of the type used for housing a plurality of connectors suitable for mounting sockets or micro-relays, which is composed of a base (1) and a plurality of holes (4) for housing connectors (2) suitable for mounting sockets or micro-relays Said holes (4) not being but instead rotated 180° with regard to the position of the adjacent holes (4) intended for housing the connectors (2) suitable for mounting sockets or micro-relays to said plugboard.

4 Claims, 2 Drawing Sheets

SOCKET USED TO HOUSE FEMALE PLUGS AND MICRO-RELAYS

BACKGROUND OF INVENTION

1. Object of the Invention

The present invention, a plugboard for housing sockets and micro-relays, consists of a multiple terminal connector plugboard structure for carrying out electrical inter-connections. This device will be especially useful in certain applications, particularly in the automobile sector, where reliability as well as quickness in carrying out the inter-connections are required, requiring a special design and concept of the connector devices used.

It is because of this that the present invention will be of special interest for the manufacturing and supply sector of electric connection equipment, and in auxiliary devices used for the automobile industry.

2. Description of the State of the Art

Currently, quickly and easily carrying out electric inter-connections is a requirement in most of the auxiliary industries, where a required reduction of assembly times has promoted the development of new types of connectors. Said connectors are fundamentally based on the constitution of connection boxes, which can be fitted together, provided with closure and clamping flanges between both plug tap and socket parts of the connectors. Likewise, carrying out the connection is done so by over-coming a specific pressure of said flanges, which cause the coupling of both plug tap and socket parts, the connection thereby being carried out.

For housing certain electric devices, the connectors, sockets or micro-relays, plugboards are used, by means of which the placement and connection thereof are facilitated, acting as physical protection of the terminals of the elements connected to them.

Traditionally the connection of the sockets or micro-relays to the plugboard is done by inserting them in aligned holes and with determined plugboard dimensions, always under conditions of lack of space conditioned by the necessity of the saving thereof. The fixing to the plugboard is carried out by means of two pins each in wedge form, each one placed on opposite sides of the socket or micro-relay. In the case of a plugboard intended for housing three sockets or micro-relays with aligned holes intended for housing them, only the central socket or micro-relay is fixed to the plugboard by both pins because it can open both pins due to the composition of the plugboard and the arrangement of the holes. The other two side holes, due to the lack of space, would only permit one of the sockets or micro-relay pins to be opened, giving way to a lack of stability in the connection and bad contact between electric components.

DESCRIPTION

The plugboard for housing sockets and micro-relays which is illustrated in the present description basically consists of a plugboard of the type used for housing connectors suitable for mounting sockets or micro-relays, composed of a base and a plurality of connectors mounted therein. The distribution of said connectors, such that the connection is ensured with the traditionally used means, consists of arranging the holes intended for housing the connectors, instead of the traditionally aligned form, by shifting alternating holes 180° of each other, every other hole of said housing shifted said 180°.

In this form and on shifting and varying the position of the alternating holes, one for every two holes, in the plugboard itself, all of the connector pins, usually two per connector, can be opened on the inside thereof, ensuring the connection between said plugboard and said connectors housed in it and permitting a suitable fluidity of the electric flux between the different parts.

BRIEF DESCRIPTION OF DRAWINGS

In order to facilitate the understanding of the plugboard for housing sockets and micro-relays, drawings are attached to the present patent application whose purpose is a better understanding of the claimed invention, and a better understanding of the description of a preferred embodiment, taking into account that the character of the drawings is illustrative and non-limiting.

DETAILED DESCRIPTION

Figure 1:
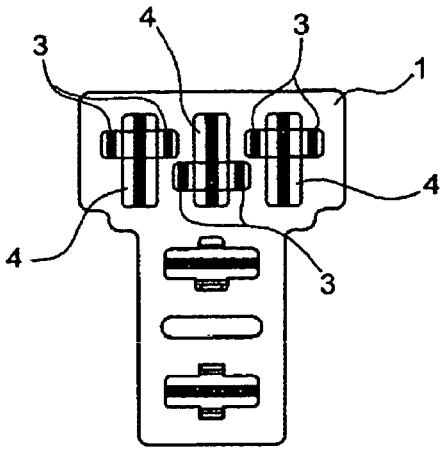
FIG. 1 shows a schematic view of a plugboard for housing sockets and micro-relays of the present invention with a detail of the distribution of the connectors mounted therein.
Figure 2:
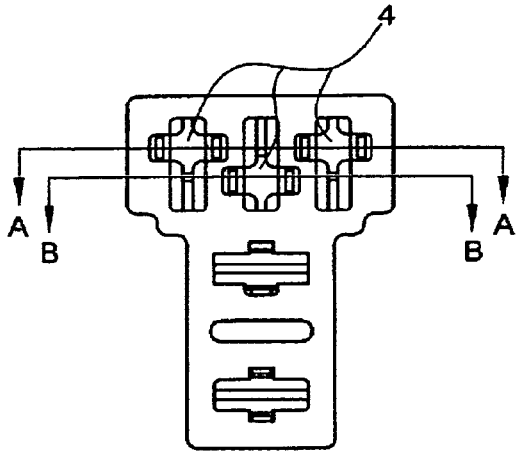
FIG. 2 shows a cross section view of a plugboard for housing sockets and micro-relays with said sockets and micro-relays inserted.
Figure 3:
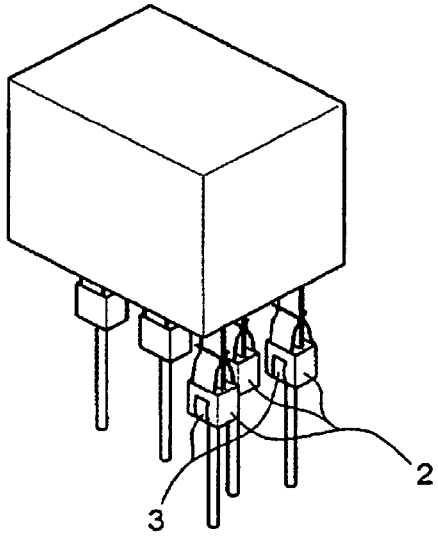
FIG. 3 shows a perspective view of a micro-relay inserted into the connectors with the base removed to more clearly show the connectors and the connector pins.
Figure 4:
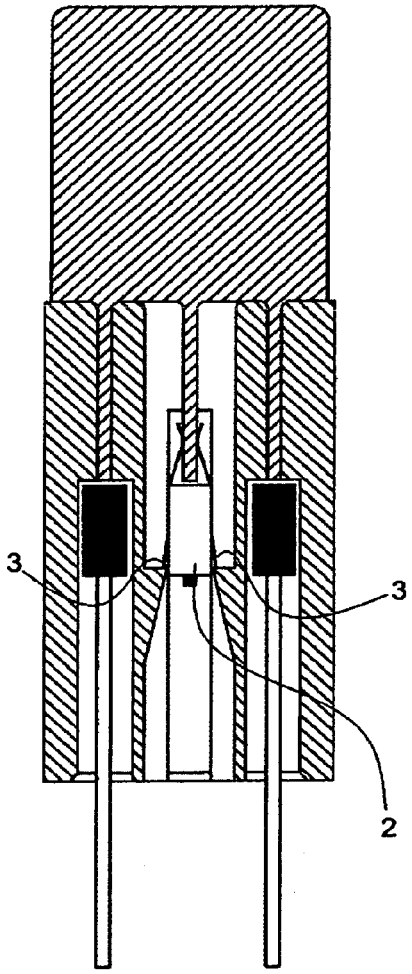
FIG. 4 shows a plan view through Line A—A of FIG. 2.
Figure 5:
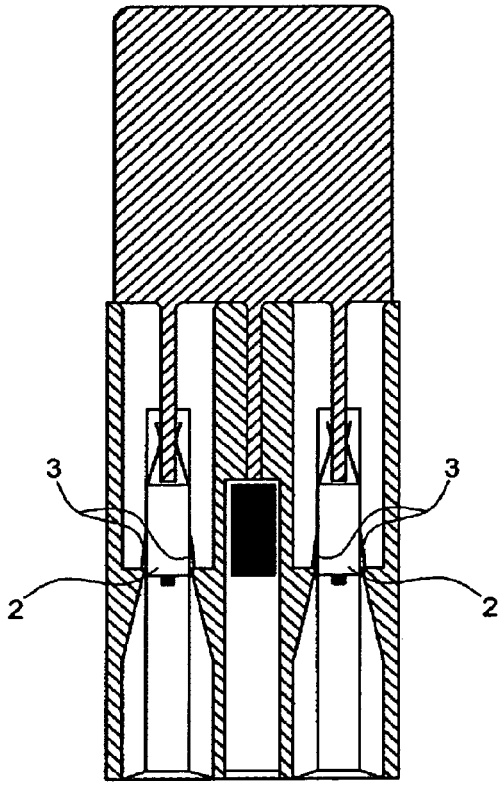
FIG. 5 shows a plan view through Line B—B of FIG. 2.

According to the embodiment example shown, the plugboard for housing sockets and micro-relays illustrated in this preferred embodiment is a plugboard with the traditional dimensions of the ones used for housing connectors suitable for mounting, sockets or micro-relays, composed of a base (1) having a plurality of connector mounting holes (4) and a plurality of connectors (2). The distribution of the connectors (2), ensuring the connection with traditionally used means with no need to modify the design of the traditional connectors (2) suitable for mounting sockets or micro-relays, is provided with three holes (4), every other hole (4) being shifted 180°.

Thus, in the plugboard itself, the two pins (3) of each of the connectors (2) can be opened, ensuring the connection between plugboard and connectors housed in it.

Although the preferred embodiments of the present invention has been disclosed, various changes and modifications may be made without departing from the scope of the invention as set forth in the appended claims.

The invention claimed is:

1. A plugboard for housing sockets and micro-relays in connectors attached by connector pins in holes in said plugboard using a reduced amount of plugboard space while allowing all said connector pins to open and secure said connectors within said holes, of the type having a plurality of connectors, allowing connection of a plurality sockets or micro-relays, consisting of: a base (1) having a plurality of holes (4) for housing connectors (2), each of said plurality of connectors (2) having a pair of connector pins (3), characterized in that said holes (4) are rotated 180° with regard to the position of the adjacent holes intended for housing said connectors (2) in said plugboard.

2. A plugboard for housing sockets and micro-relays in connectors attached by connector pins in holes in said plugboard using a reduced amount of plugboard space while allowing all said connector pins to open and secure said connectors within said holes according to claim 1, characterized in that said base (1) is provided with three holes (4)

for housing three connectors (2) suitable for mounting, sockets or micro-relays, wherein the central hole (4) is aligned 180° with regard to the two remaining holes (2) intended for housing said connectors (2).

3. A plugboard for housing sockets and micro-relays in connectors attached by connector pins in holes in said plugboard using a reduced amount of plugboard space while allowing all said connector pins to open and secure said connectors within said holes according to claim 1, characterized in that in each one of the holes of the plugboard, all the pins (3) of the connectors, sockets, or micro-relays (2) can open, ensuring the connection between plugboard and connectors, sockets or micro-relays introduced in said holes.

4. A plugboard for housing sockets and micro-relays in connectors attached by connector pins in holes in said plugboard using a reduced amount of plugboard space while allowing all said connector pins to open and secure said connectors within said holes according to claim 2, characterized in that in each one of the holes of the plugboard, all the pins (3) of the connectors, sockets, or micro-relays (2) can open, ensuring the connection between plugboard and connectors, sockets or micro-relays introduced in said holes.

* * * * *